US007317406B2

(12) United States Patent
Wolterman

(10) Patent No.: US 7,317,406 B2
(45) Date of Patent: Jan. 8, 2008

(54) INFRASTRUCTURE-BASED COLLISION WARNING USING ARTIFICIAL INTELLIGENCE

(75) Inventor: Mike Wolterman, Brighton, MI (US)

(73) Assignee: Toyota Technical Center USA, Inc., Ann Arbor, MI (US)

( * ) Notice: Subject to any disclaimer, the term of this patent is extended or adjusted under 35 U.S.C. 154(b) by 186 days.

(21) Appl. No.: 11/050,045

(22) Filed: Feb. 3, 2005

(65) Prior Publication Data

US 2006/0181433 A1 Aug. 17, 2006

(51) Int. Cl.
*G08B 1/095* (2006.01)

(52) U.S. Cl. ..... 340/917; 340/905; 340/906; 340/907; 340/910

(58) Field of Classification Search ..... 340/917, 340/905, 906, 907, 908, 910, 916
See application file for complete search history.

(56) References Cited

U.S. PATENT DOCUMENTS

| | | | | |
|---|---|---|---|---|
| 1,195,583 | A | 8/1916 | Henretta | |
| 3,275,984 | A | 9/1966 | Barker | |
| 4,908,615 | A | 3/1990 | Bayraktaroglu | 340/917 |
| 5,444,442 | A | 8/1995 | Sadakata et al. | 340/916 |
| 5,617,086 | A * | 4/1997 | Klashinsky et al. | 340/907 |
| 5,777,564 | A | 7/1998 | Jones | 340/917 |
| 5,917,432 | A | 6/1999 | Rathbone | 340/907 |
| 6,008,741 | A | 12/1999 | Shinagawa et al. | 340/907 |
| 6,198,410 | B1 | 3/2001 | White et al. | 340/907 |
| 6,204,778 | B1 * | 3/2001 | Bergan et al. | 340/936 |
| 6,281,808 | B1 | 8/2001 | Glier et al. | 340/933 |
| 6,307,484 | B1 | 10/2001 | Sasaki et al. | 340/903 |
| 6,351,208 | B1 | 2/2002 | Kaszczak | 340/425.5 |
| 6,516,273 | B1 | 2/2003 | Pierowicz et al. | 701/301 |
| 6,559,774 | B2 * | 5/2003 | Bergan et al. | 340/908 |
| 6,633,238 | B2 | 10/2003 | Lemelson et al. | 340/909 |
| 6,662,099 | B2 | 12/2003 | Knaian et al. | 701/117 |

FOREIGN PATENT DOCUMENTS

| | | |
|---|---|---|
| JP | 05-046897 | 2/1993 |

* cited by examiner

*Primary Examiner*—Daryl C Pope
(74) *Attorney, Agent, or Firm*—Gifford, Krass, Sprinkle, Anderson & Citkowski, P.C.

(57) ABSTRACT

An improved apparatus for controlling a traffic signal at an intersection includes a signal controller having an artificial intelligence based situational analyzer. The signal controller receives vehicle data related to the speed and position of vehicles approaching the intersection, and optionally time and ambient condition data. If the artificial intelligence based situational analyzer predicts a signal violation, operation of the traffic signal is modified to reduce the probability of a vehicular collision.

27 Claims, 4 Drawing Sheets

INFRASTRUCTURE-BASED COLLISION WARNING USING ARTIFICIAL INTELLIGENCE

FIELD OF THE INVENTION

The invention relates to transportation, in particular to methods and apparatus for reducing the probability of vehicle collision at an intersection.

BACKGROUND OF THE INVENTION

Vehicle traffic accidents are a leading cause of death and serious injury. Many accidents occur at controlled intersections, such as those having traffic signals.

A conventional controlled intersection includes stop lights on a yellow-red-green cycle. In some circumstances, the speed of the cycle may be increased at times of low traffic volume. However, the cycle is conventionally not modified in response to weather conditions, driver behavior, or other unexpected or non-predictable events. The phase of a traffic signal generally is preprogrammed, and only responsive to predictable conditions, such as time of day.

Stop light controlled intersections are a major hazard. In many circumstances, a light turns red, yet a vehicle will still pass through the intersection. A vehicle on a crossing path may have received a green light or a green left-turn arrow, and is then at risk from an impact of a vehicle that was unable or unwilling to stop for a red light.

Hence, it would be advantageous to provide an improved traffic control system that is responsive to driver behavior. Such an improved system would provide a safer driving environment.

SUMMARY OF THE INVENTION

An apparatus for controlling a traffic signal at an intersection comprises a vehicle sensor providing vehicle data, such as vehicle speed and vehicle position, and, optionally, an ambient condition sensor, providing ambient condition data for the intersection, and a signal controller controlling the traffic signal. The signal controller includes an artificial intelligence based situational analyzer receiving the vehicle data and, optionally, ambient condition data and a time signal.

In one example, a vehicle approaches the traffic signal at the intersection, which may be a stop sign or flashing red light, continuous red light, yellow light, green light about to change, or other signal. The AI situational analyzer determines a stopping deceleration necessary for the vehicle to avoid violating a stop signal, and provides a violation prediction if the stopping deceleration exceeds a threshold deceleration. The violation prediction leads to a modification of the traffic signal operation to reduce the probability of a collision between vehicles at the intersection.

The signal controller may further include a clock or otherwise receive a time signal, and the threshold deceleration can be higher during certain time intervals, such as rush hour periods. These periods may be known to be associated with aggressive driving, including rapid decelerations at stop signals. An AI based system can determine time periods where average vehicle stopping decelerations are higher, and increase the threshold deceleration during those periods.

The artificial intelligence based situational analyzer may use a pattern analysis of previous vehicle data and previous signal violation events to determine the threshold deceleration, or otherwise determine the probability of a signal violation.

The AI system may also use a typical stopping deceleration under similar ambient conditions to predict a signal violation. For example, the threshold deceleration can be reduced if ambient condition data are correlated with a reduced road friction coefficient. Such ambient conditions may include below-freezing temperatures, the presence of surface moisture or standing water, falling precipitations, past precipitation (for example, using stored ambient condition data, or an ambient condition sensor providing a precipitation signal for a certain time after precipitation has fallen), and the like. Ambient condition data can include temperature data and other weather-related data, and can be stored in an accessible memory.

The operation of the traffic signal can be modified, for example so as to provide a delayed green light, delayed green left turn arrow, and/or a warning light (such as a strobe light, a red bar over the green light, a yellow light, or a white light).

A method of reducing a probability of a collision in an intersection having a traffic signal includes determining vehicle data for a vehicle approaching the intersection, the vehicle having a stop signal, the vehicle data including vehicle speed and vehicle position, determining signal phase, and comparing vehicle data to a pattern analysis of stored data, the stored data including previous vehicle data relating to vehicles previously passing through the intersection, and predicting a signal violation using this comparison. The signal violation prediction can be used to modify the signal operation to reduce the probability of a collision, for example by modifying signal phase (e.g. by delaying a signal change) or by illuminating warning lights.

DETAILED DESCRIPTION OF THE INVENTION

An improved apparatus for controlling a traffic signal at an intersection includes an artificial intelligence (AI) based situational analyzer. The term AI system will also be used to describe an AI based situational analyzer. The AI system receives vehicle data, related to the speed and position of vehicles approaching the intersection. The AI system may additionally receive ambient condition data and a time signal.

In one example, a vehicle approaches a traffic signal at the intersection, and a stopping deceleration for the vehicle to avoid violating a stop signal is determined. This stopping deceleration may be determined for the vehicle at a particular location close to the intersection, or may be determined continuously as a time-dependent value, or otherwise be determined. The signal controller provides a violation prediction if the stopping deceleration exceeds a threshold deceleration.

The threshold deceleration can be determined, in part, using pattern analysis of stored data. For example, the probability of a vehicle running a stop signal, for a given stopping deceleration, may increase for one or more conditions, alone or in combination, such as below-freezing temperatures, time of day (such as late night driving or weekend driving), weather conditions such as fog or precipitation, roadway condition such as roadway moisture, previous weather conditions such as rain, sequential ambient conditions such as rain followed by freezing temperatures, and the like. Each individual signal controller may learn which conditions influence the ability and likelihood of a vehicle to stop at a stop signal. In other examples, individual signal controllers can be preprogrammed with such typical effects of ambient conditions and time of day, and which optionally may be modified by learned properties of the intersection.

Figure 1:
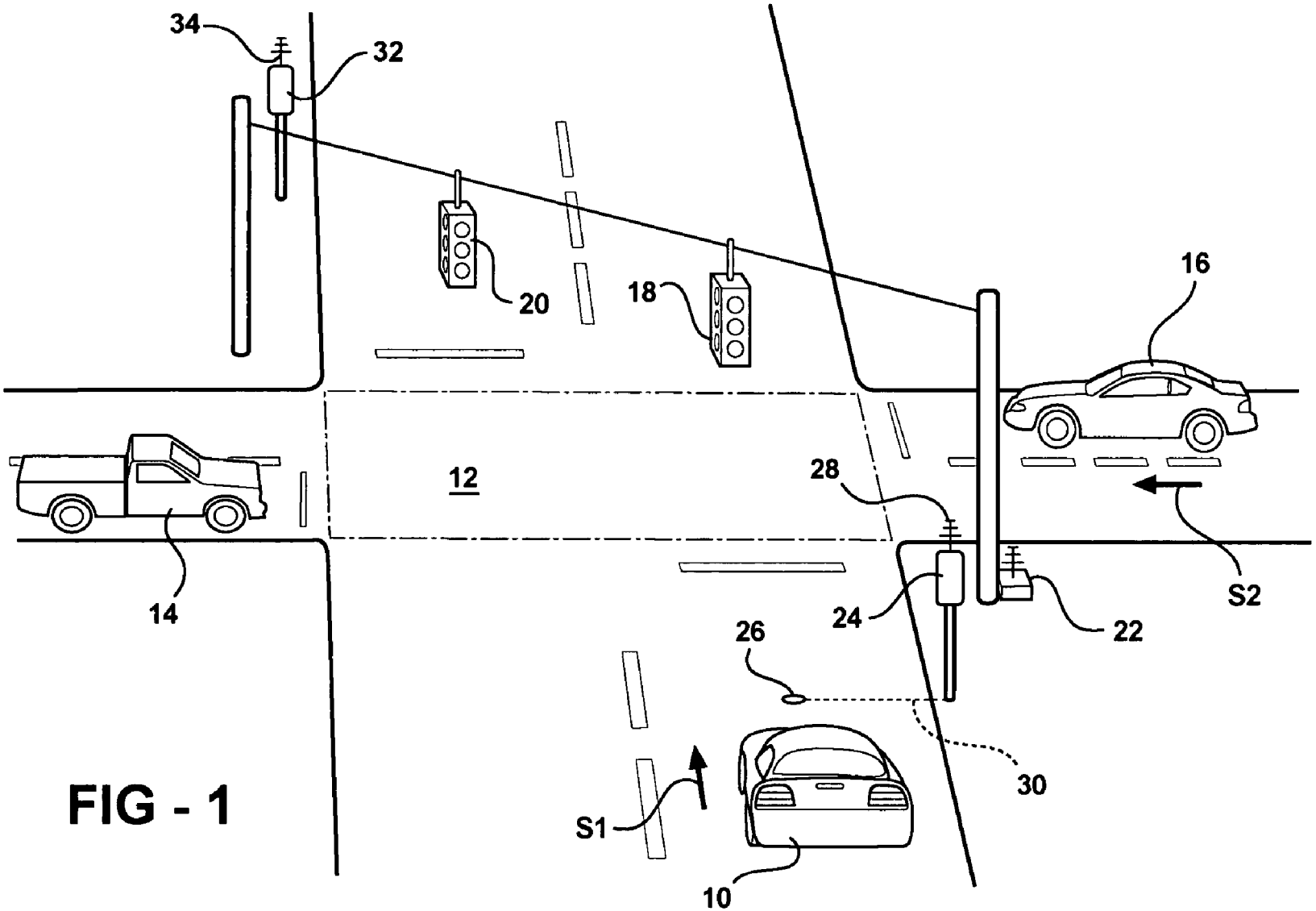
FIG. 1 shows a view of a traffic intersection having stop light control, further comprising an artificial intelligence system and external sensor systems.

FIG. 1 shows a representative view of the environment of a traffic intersection, showing first vehicle 10 moving at speed S1 on a first route, an intersection 12 between two crossing routes, a second vehicle 14 stopped on a second route crossing the first route at the intersection, a third vehicle 16 approaching the intersection from the second route at a speed S2, traffic signal 18, second traffic signal 20, an artificial intelligence (AI) situational analyzer (or AI system) 22, sensor system 24, a roadway sensor 26 embedded in the road surface of the first route, antenna 28, electrical lead 30 connecting the roadway sensor to the sensor system, and a second sensor system 32, the second sensor system having an antenna 34.

In this example, the AI situational analyzer (hereinafter, AI system) 22 receives speed data from a speed sensor within the sensor system 24. The speed data may be provided by a radar system, time sequential images, or other speed measuring device. The AI system is shown located within a separate housing; however it may be located with a sensor system, in a traffic signal, within a support structure for a traffic signal, or otherwise located.

The AI system also receives ambient condition data from the sensor system 24, which may include temperature data from a temperature sensor, precipitation data from a precipitation sensor, the presence of fog, mist, or precipitation falling in or close to the intersection (detected, for example, through transmission of a beam between the first and second sensor systems, such as an optical beam or radar beam), or data correlated with one or more other conditions that may be hazardous to vehicle operation.

The sensor system 24 transmits data wirelessly to the AI system 22 using an antenna. However, wired or other connections may be used.

The Figure shows a second vehicle 14 stopped at the intersection. In one scenario, a traffic signal (such as traffic signal 18 or 20) indicates a red light to the first vehicle 10, and at a slightly delayed time, under conventional operation, the traffic signal would illuminate a green light to the stopped vehicle 14.

With a conventional system, the second vehicle 14 would then enter the intersection after receiving the green light. However, if the first vehicle is moving at such a speed that it could not safely stop at the intersection, the second vehicle would be at risk of a collision with the first vehicle.

The AI system can provide one or more warnings or modification of the signal sequence so as to reduce the risk of a collision. In one example, the AI system determines the speed and distance of the first vehicle from the intersection. The AI system then determines a stopping deceleration required for the vehicle to stop at a red stop light, and compares the stopping deceleration with a threshold deceleration.

The stopping deceleration can be determined using one or more traffic sensors to determine position, speed, and (optionally) acceleration of the first vehicle. Vehicle speed and position can be determined using video imaging (for example, with speed determined from time-sequential vehicle images), radar reflection, one or more roadway sensors, and the like, or some combination of sensing methods. Image analysis can be used to determine the type of vehicle, and the threshold deceleration can be correlated with vehicle type using known or learned vehicle characteristics.

For example, in dry conditions, a threshold deceleration of 0.1 to 0.2 g may be acceptable. In adverse conditions, such as ice, snow, rain, and the like, the threshold deceleration can be lowered, for example to below 0.1 g, for example 0.05 g, or to a value learned to be suitable in similar conditions.

If the stopping deceleration exceeds the threshold deceleration, further warnings may be both targeted at the moving vehicle and provided generally to other vehicles in the vicinity of the intersection. For example, the moving vehicle may see an enhanced intensity red light, a flashing light such as a flashing strobe light, additional warning signs, or other warning signals transmitted to the vehicle.

Even if the normal signal phase would provide a green light to vehicles on a crossing path to the moving vehicle, the signal can provide a sustained red light (delayed green light), a warning light, or a conditional green light (green light accompanied by a warning) if the AI system predicts a violation of a red light by the first vehicle.

A conditional green light may include a green light accompanied by a warning that it may be hazardous to enter the intersection. The conditional green light may comprise a green light accompanied by a strobe flash, a flashing yellow light, or other accompanying warning signal. A warning light may include a flashing yellow light, a flashing red light, a strobe light, or other warning light.

An enhanced warning may be provided to the third vehicle 16 if a collision is predicted between the third vehicle and the first vehicle.

Figure 2:
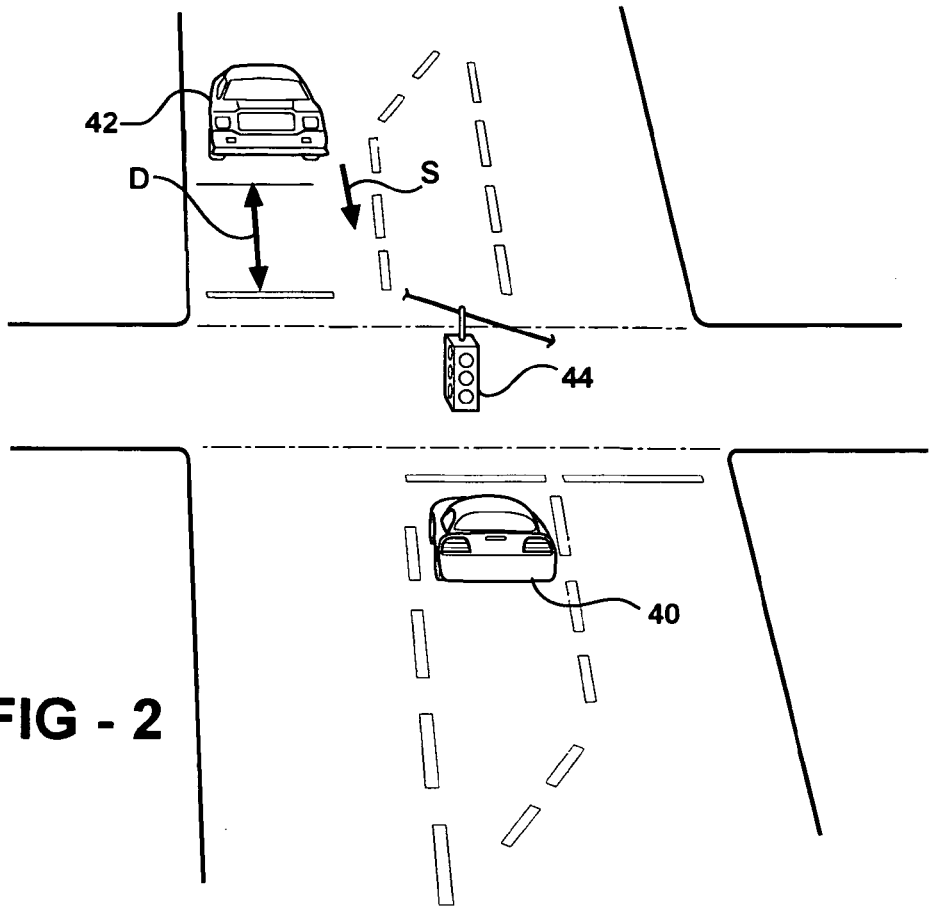
FIG. 2 shows a view of a traffic intersection, in which a vehicle is waiting to turn left in front of an oncoming vehicle, the traffic signal providing a warning to the left turning vehicle if it is unsafe to make a left turn.

FIG. 2 shows another view of an intersection, in which stopped vehicle 40 is waiting for a left-turn arrow on traffic signal 44 before turning left in front of the direction of moving vehicle 42. If the AI system determines that the moving vehicle cannot safely stop in time, the signaling may be controlled in one of several ways.

In a first example, the moving vehicle is displayed a red light, indicating to the vehicle operator and to any onlookers that the vehicle has committed a traffic infraction. However, the stopped vehicle 40 may not be shown a green arrow in this circumstance. For example, the provision of the green arrow may be delayed until the moving vehicle has passed through the intersection.

Alternatively, the stopped vehicle may be shown a warning light, such as a green light accompanied by an additional warning light, a flashing yellow light, or other combination of visual signals.

Figure 3B:
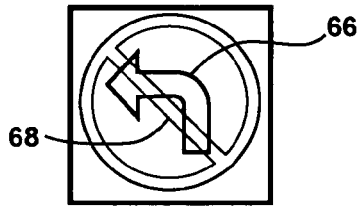
FIGS. 3A and 3B show a modified left turn signal, in which a further warning can be provided to a driver if the system determines that it may be unsafe to make a left turn.
Figure 3A:
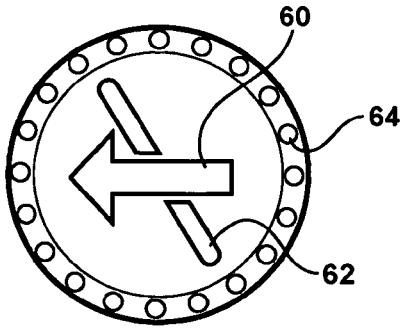

FIG. 3A shows an example of a modified left-turn arrow, providing a conditional green light, including conventional green arrow 60, diagonal light bar 62, and a circular pattern of lights 64. For example, the diagonal light may be a red bar extending across the green arrow, may include a flashing red, yellow or other color light, strobe, or other colored or white light. The circular light pattern 64 may include a number of flashing lights, such as flashing yellow light-emitting diodes (LEDs).

Figure 3C:
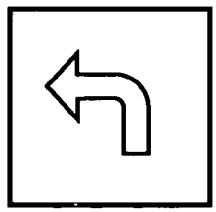
FIG. 3C shows a conventional left turn signal.

FIG. 3B shows another example of a modified left-turn arrow. A conventional left-turn arrow 66 is shown partially obscured by the circle and bar pattern 68. FIG. 3C illustrates a conventional left-turn arrow without accompanying warning signals.

Figure 4:
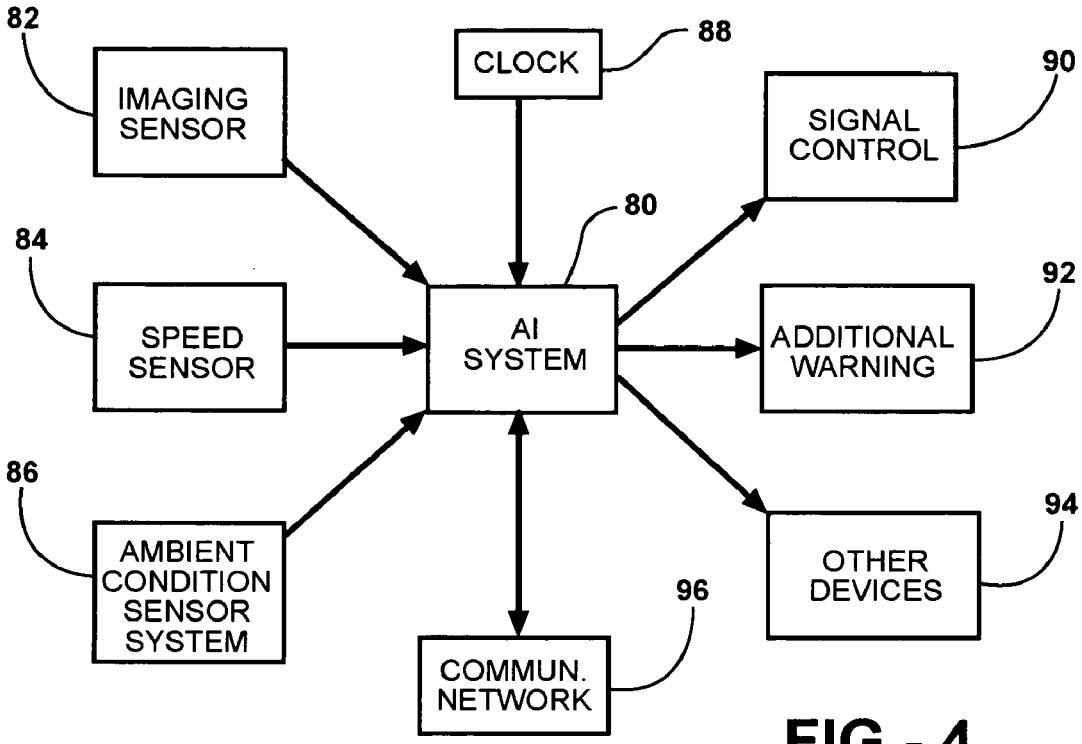
FIG. 4 is a schematic representation of a system including an artificial intelligence-based situational analyzer, receiving data from a plurality of sensor systems and controlling one or more signaling devices.

FIG. 4 illustrates a system according to the present invention. The AI system 80 receives data from an imaging sensor 82, speed sensor 84, ambient condition sensor system 86, clock 88, and (optionally) external data over a communications network 96. The AI system is operable to control the light sequence through signal control 90, and also to operate additional warning devices through additional warning control 92. The AI system may communicate with or operate other devices through link 94.

Figure 5:
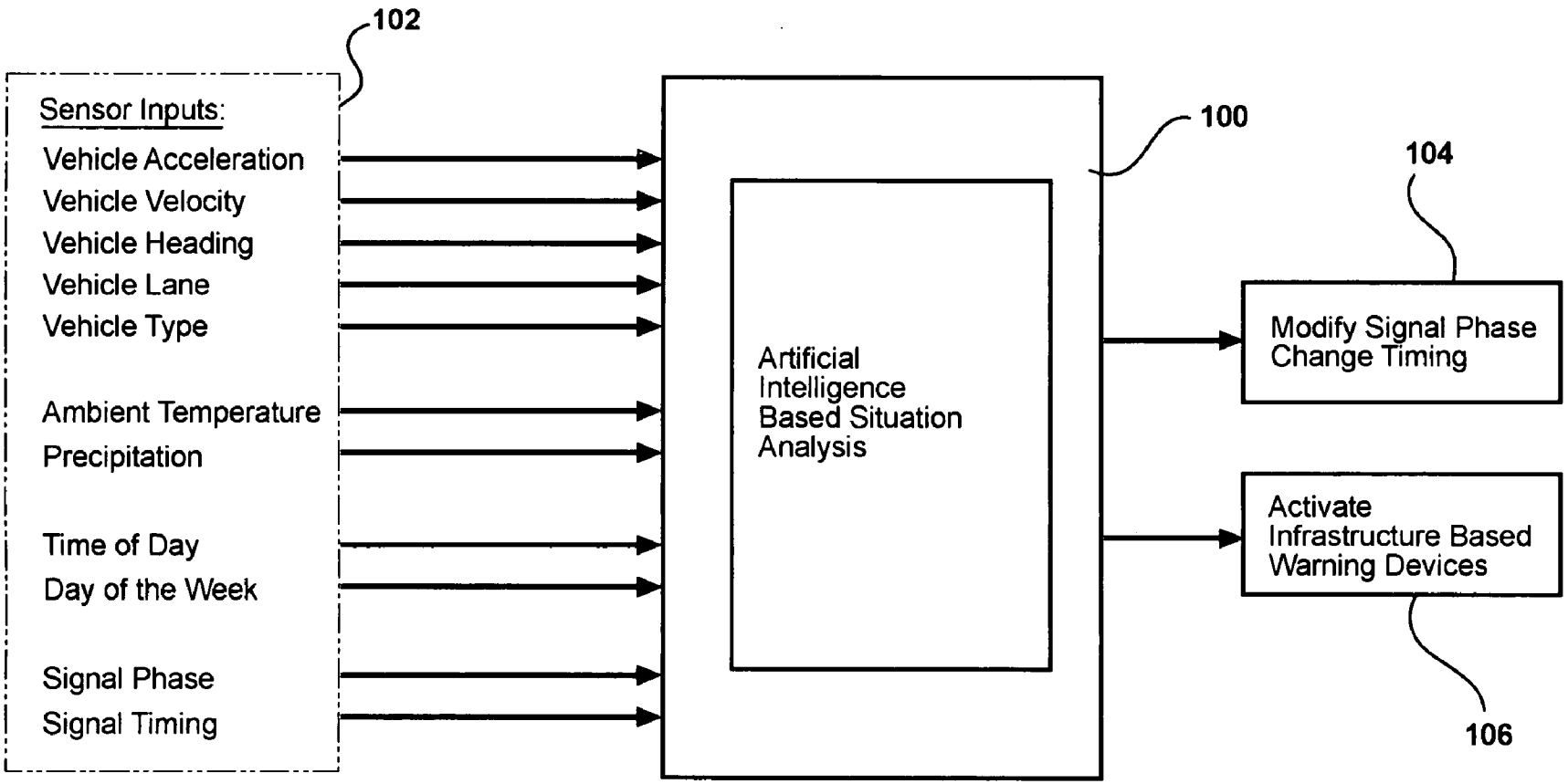
FIG. 5 is a further schematic representation of an infrastructure-based collision warning system.

FIG. 5 is a schematic of a system according to the present invention. An AI based situational analyzer 100 receives a plurality of sensor inputs from a sensor system 102, including vehicle data (such as vehicle acceleration, vehicle velocity, vehicle heading, vehicle lane, and vehicle type), ambient condition data (such as ambient temperature and precipitation), time data (such as time of day and day of week), and signal data (such as signal phase and signal timing). The AI based situational analyzer 100 provides outputs to signal control 104 operational to modify signal phase and change timing, and warning control 106 operational to activate infrastructure based warning devices.

Figure 6:
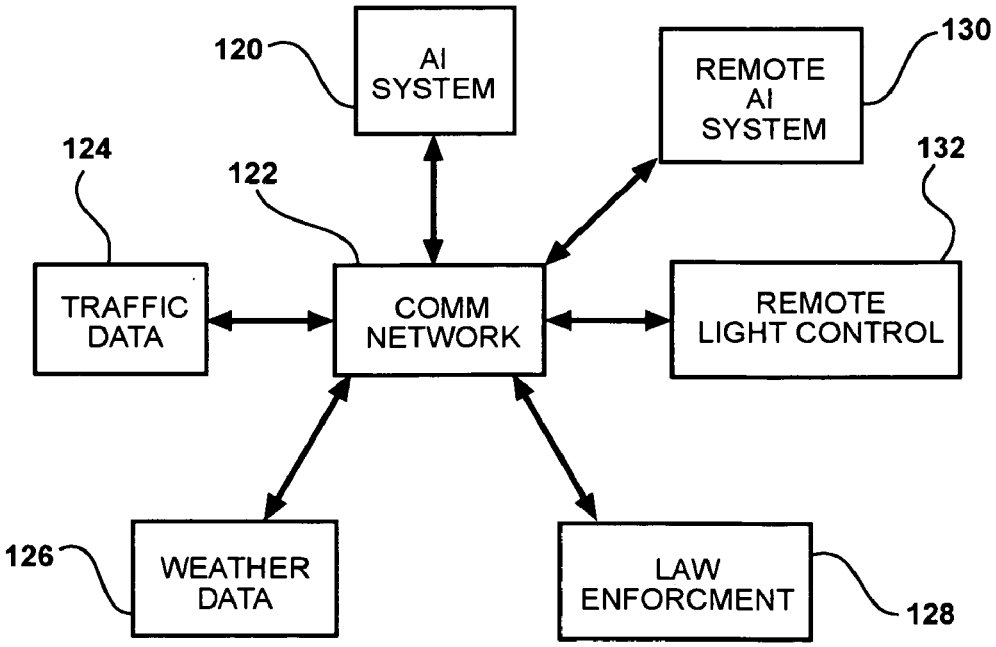
FIG. 6 is a schematic representation of a communication system by which an artificial intelligence-based warning system is in communication with external sources of data, and can also transmit data to other similar systems, law enforcement or other external devices.

FIG. 6 is a schematic of a system in which the AI system associated with one intersection may communicate with remote AI systems and other devices. The system includes the AI system 120, communications network 122, a source of traffic data 124, a source of weather data 126, a law enforcement computer 128, a remote AI system 130, and a remote light control 132.

For example the AI system may receive traffic data from an external source, such as other traffic monitoring devices. The AI system may receive and/or transmit weather data, for example exchanging data with other AI systems. Weather data may be received from other weather stations in the vicinity.

If the system images a vehicle passing through a stop light, information may be passed to local police, for example through a law enforcement computer system.

The traffic signals may also be controlled by a remote light controller, or receive phase timing signals from another location, for example to ensure light phases consistent with smooth traffic flow. For example, a remote light controller may provide synchronization timing pulses to modify the phase of a traffic signal. An AI system may also be used to adjust traffic signal phases to maximize traffic flow for given conditions.

The AI system may also receive data from (or transmit data to) other similar systems, or other traffic control centers or devices, weather centers, and the like. Data received and/or transmitted may include, for example, weather conditions, traffic flow volumes, erratic driver behavior, signal violations, dangerous road conditions, and the like.

Data exchange with other systems or devices may occur over local communications networks, the Internet, satellite links, or other wireless or cable links. For example, time data may be received as a wireless time signal. Pattern analysis may also be performed on aggregated data for greater prediction accuracy.

Sensors

Example systems according to the present invention can use one or more sensing devices, such as imaging devices (which may be combined with image recognition systems), active or passive radar, radiofrequency identification tags, or other sensors. Sensors may be used to monitor the velocity, acceleration, and direction of traffic flow through an intersection. The distance of a vehicle from an intersection is also determined. Sensors may also be used to monitor vehicle type and position within a lane.

For example, a sensor system can include a combination of radar and imaging devices to observe the characteristics of an intersection. The radar device can monitor the velocity and acceleration of vehicles approaching the intersection. The imaging system may also provide data on vehicle velocity, and may be combined with an optical imaging system so as to determine the type of vehicle.

Sensors may also be provided to determine ambient temperature, road temperature (for example, using a roadway sensor), precipitation (falling or fallen), standing water, ice, fog, and other ambient conditions. The system may also receive time data, comprising the time of day and also the day of the week, from a clock or through receiving a timing signal.

Ambient condition data can include light intensity (natural and/or artificial), temperature (air and/or road surface), and other weather data such as precipitation (present and/or past, precipitation including drizzle, rain, snow, freezing rain, hail, and the like), humidity, dew point, wind speed, visibility (including effects of fog, smog, dust, precipitation, blizzard conditions, and the like), sky coverage, and other ambient conditions.

For example, if the temperature is well below the dew point, surface moisture is likely, and if the temperature is below freezing, iciness is possible. Hence, ambient condition data correlated with reduced road surface friction can be used to reduce the threshold deceleration used by the AI system.

Road condition data can include road surface material (concrete, asphalt, stone, metal, gravel, resin, or other material), road surface roughness, surface wetness (including the presence or otherwise of standing water), presence of materials on the road surface (including snow, ice, salt, water, gravel, or other material).

Sensor data can include vehicle acceleration, vehicle velocity, vehicle lane, ambient temperature, current precipitation, past precipitation, fog or other visibility restricting condition, ice, fog, and the like. Sensor data can be combined with the current status of a traffic signal to determine whether an intended traffic signal change is safe.

AI System

Examples according to the present invention use artificial intelligence (AI) in the control of traffic signals. The AI system can learn from and adapt to driver behavior, changing ambient conditions, and other features that may make an intersection dangerous.

For example, the AI system may judge whether moving vehicle behavior is indicative of an aggressive driver or of a driver that is unaware of the signal. For example, driving patterns at different times of the day may be analyzed. For example, at rush hour, driver behavior may be consistent with more abrupt acceleration and braking. In such circumstances, warnings may be given to drivers only if the driver behavior is atypical for the time of day. For example, the threshold deceleration may be increased during rush hour periods to accommodate more aggressive driving.

The threshold deceleration can be expressed, for example, as a fraction of the acceleration due to gravity (g). For example during rush hour, the threshold may be set at a high level such as 0.2 to 0.3 g, such as 0.25 g. In contrast, at the weekends and outside of rush hour periods, the threshold may be set lower, for example at 0.1 g. Further, the AI system may adjust the threshold deceleration based on previous recorded data relating to driver behavior at certain times of day, and/or certain ambient conditions. The stopping deceleration may equivalently be defined in terms of vehicle speed and distance from the intersection.

The AI system, receiving speed, acceleration, and position data from the sensor system, calculates the deceleration required for a vehicle to stop at a red light. If the calculated deceleration is greater than the threshold deceleration, a warning may be provided to the driver. Further, warnings may also be provided to other drivers in the vicinity of the intersection, such as those stopped at traffic signals on crossing routes.

The AI system may further consider ambient conditions, including the weather, in determining whether a warning or modification of stop light cycle is required. For example, if ambient condition sensors indicate a high dew point and a prolonged period of time below the freezing point, the AI system may determine that the road is icy. In this case, the threshold deceleration may be lowered. For example a threshold deceleration of 0.05 g or lower may be used. If an atypical number of vehicles are detected violating the signal (i.e. running red lights), the threshold deceleration can be lowered further.

The AI system may use vehicle speed at a particular location relative to the intersection to predict the likelihood of a signal violation. However, this is equivalent to determining a stopping deceleration, as the vehicle would then have to decrease speed by a known amount over a known distance to stop.

The length of a yellow light (between green and red in a typical signal cycle) can be inversely correlated with the threshold deceleration. For example, if the threshold deceleration is low due to hazardous ambient conditions, the yellow light can be lengthened. However, there may be predetermined minimum or maximum durations for the yellow light.

The AI system can analyze sensor inputs, and predict the actions of vehicles approaching the intersection. The predictions can be used to provide warnings to vehicles, and also to modify the operation of any traffic signals.

An advantage of the system described herein is that warnings can be provided to vehicle operators using appropriate infrastructure. The driver need not have separate warning devices within the vehicle. Hence, this can be advantageous in both reducing the cost of such a system to a driver, and also by not needing vehicles to be modified in any way.

If the AI system determines that a driver is about to violate the intersection, the system may respond in one or more ways. For example, vehicles on crossing routes or left-turn lanes may experience a red light until the moving vehicle has passed through the intersection.

One problem with this approach is the risk that drivers become aware that speeding towards an intersection may give them extra time to get through the intersection. In response to this, vehicle images may be recorded and sent to law enforcement. For example, the AI system described here may be combined with conventional speed camera systems. Further, the driver approaching a red light at high speed may receive a warning that failure to stop will result in their vehicle being imaged along with the likelihood of a subsequent traffic ticket.

As data is collected for an intersection throughout a period of time, the AI system learns the characteristics of that intersection. These characteristics may include aggressive driving at certain times of the day such as rush hour, and normal or more passive driving at other times.

In addition, weather conditions and other ambient condition data can be used to modify the operation of the traffic signal. For example, if snow or rain is detected, an extended yellow light may be provided. The length of yellow lights required may be determined in part from measurements of traffic behavior during the periods of inclement weather. For example, the sensor data may show that traffic continues through an intersection for a certain period of time after a light has turned red, possibly due to low friction roadway surfaces. In this case the length of the yellow light can be extended to account for the effects of the bad weather.

The combination of sensors and AI allows the system to learn the traffic patterns of a given intersection. Further, the learned knowledge can be used to provide warnings to drivers and also to modify the operation of traffic signals to reduce collision hazards.

In other examples, a system can be adapted to determine whether an intended maneuver is safe. For example, sensor data can be used to indicate whether a left-hand turn can safely be made on a blinking red light. An additional warning can be activated if there is danger from oncoming traffic approaching the intersection. The system also includes a learning function, by which analyzed behavior of vehicles passing through an intersection is used to influence the decision making process.

In other examples of this invention, previous weather conditions can be used to influence the AI decision making process. For example if sensor records indicate that a dry spell has been followed by a period of precipitation, additional time can be provided to allow vehicles to stop.

Warnings

Warnings may be targeted at a moving vehicle likely to violate a traffic signal, and to other vehicles stopped or approaching the intersection, for example that may be at risk of collision with the moving vehicle if they enter the intersection. Warnings may include visual indications, sounds, changed road surface properties, radio signal transmissions, or some combination.

Warnings may include enhanced brightness of a red light, flashing red lights, flashing strobe lights, operation of additional warning signs such as flashing red lights, flashing lights embedded in the roadway, and other forms of visual indication. Warning signs provided generally to other vehicles in the vicinity of the intersection may include similar lights, or conventional warning lights such as flashing yellow lights. Warnings may also include illuminated speed limit signs, yield signs, and the like. Speed limits may be reduced for vehicles approaching the intersection, for example by modifying an electronic display.

If a vehicle is detected violating a red light, the subsequent traffic signal on the route of the violator may be turned red, so as to allow law enforcement to intercept the vehicle.

In other examples, if an imminent violation is detected, all traffic control devices are set to red, to prevent other vehicles entering the intersection as the violator passes through. This may also facilitate visual imaging of the violator.

The AI system determines if a violation of the traffic signal (such as a vehicle running a red light) is possible or likely. A threshold probability, such as 10%, 30%, 50%, or other probability, may be used before a violation prediction is given. The AI system can correlate the violation probability with ambient condition data, time data, and the like, using learned properties of the intersection.

Hence an improved traffic control system is provided that uses AI-based situation analysis and various sensor inputs to activate warning devices at an intersection or change traffic signal timing when there is a determined risk of collision.

Warnings Transmitted to Vehicles

Examples according to the present invention do not require in-vehicle warning systems. However, warnings can be provided to vehicle operators using in-vehicle warning systems, if present, so as to further reduce the possibility of a collision.

For example, a vehicle radio receiver or other audio entertainment device may be provided in a vehicle that allows a warning to be provided to the vehicle operator. For example, detection of a specific radio frequency, modulation frequency, or other signal may trigger the sounding of an alarm. For example, a radio signal, optical signal, IR signal, or other signal may be modulated in a predetermined way. Signals detected within a predetermined band may over-ride a conventional radio signal, and allow transmission from the AI system of the present invention to the vehicle operator.

Road Surface Properties

The frictional properties of the road surface can be included in a model used by the AI system. By example the nature of the road surface, such as concrete or asphalt, and also the surface roughness, and further the presence of potholes and other defects, can also influence the stopping distance of vehicles approaching the intersection. A roadway sensor may be used to measure road surface temperature, determine the presence of standing water, and the like.

Emergency Vehicles

A signal controller according to the present invention may further include a sensor for detecting the approach of an emergency vehicle towards the signal. Sensor may respond to IR, optical, radio, other electromagnetic, ultrasound, or other signals. For example, an optical sensor may provide image data or other sensor signals recognized by an AI system as originating from the emergency light of an emergency vehicle. An acoustic sensor may detect a characteristic siren sound, which may be recognized by an AI system. An AI system may use multiple sensor inputs to determine the position of the emergency vehicle. Roadside or in-road detectors may provide signals characteristic of an emergency vehicle.

Security Barrier

Examples of the present system can be used to provide improved security barriers, for example for entrances to businesses or government facilities. An AI system determines the likelihood of a moving vehicle failing to stop at a barrier (such as a checkpoint), for example from comparing a required stopping deceleration with a predetermined threshold deceleration which may vary with ambient conditions, time of day, commuting and non-commuting periods, day of the week, and the like. If the AI system determines a vehicle is unlikely to stop, additional mechanisms such as gates, tire rippers, and the like may be deployed, and a warning may sound or be displayed.

OTHER EXAMPLES

Hence, an improved apparatus for traffic control includes first signal to first vehicles on a first route. In examples of the present invention, the first signal comprises a red light, a yellow light, and a green light, the green light being energizable to provide a go signal, the red light being energizable to provide a stop signal.

The first signal can further comprise a warning light, energizable together with the green light so as to indicate a go signal accompanied by a warning of a possible collision with a moving vehicle on a second route. A warning light can include a non-green colored bar or other obscuration across the green light (such as a yellow or red bar), a strobe lamp across the green light, a yellow light or other light illuminated together with the green light. The green light may be a green arrow.

The improved apparatus further includes an artificial intelligence based situational analyzer operable to predict a possible collision using speed data related to the moving vehicle, and ambient condition data including temperature and moisture presence on the first and/or second routes.

System according to the present invention can also be used in relation to signal control of other vehicles, such as ships in waterways, flying vehicles, and the like.

A pedestrian sensor may be used to detect the presence of a pedestrian in the intersection, and the AI system used to control the signals provided to vehicles so as to reduce a possibility of the pedestrian being hit. An impact prediction for a vehicle approaching a pedestrian in an intersection may be treated in an analogous fashion to the possible violation of a traffic signal. For example, a red light or additional warning light may be displayed.

If sensors detect stopped traffic, a warning may be provided to vehicles approaching the intersection so as to allow them to slow or stop safely. For example, a "stopped traffic ahead" warning may be illuminated. A vehicle may be approaching a green light, and not be aware that despite the green light, traffic near the intersection is not moving. Enhanced warnings may be provided at vehicles approaching the intersection at, for example, greater than a threshold speed. Warnings and vehicle sensors can be provided in advance of the intersection, such as 500 yards, a mile, or other suitable distance in advance.

The invention is not restricted to the illustrative examples described above. Examples are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the claims.

Patents, patent applications, or publications mentioned in this specification are incorporated herein by reference to the same extent as if each individual document was specifically and individually indicated to be incorporated by reference.

I claim:

1. An apparatus for controlling a traffic signal at an intersection of a first route and a second route, the traffic signal providing a first signal to a first vehicle on the first route, and a second signal to a second vehicle on the second route, the apparatus including:

a vehicle sensor, operable to provide vehicle data for the first vehicle, the vehicle data including vehicle speed and vehicle position;

an ambient condition sensor, providing ambient condition data for the intersection; and a signal controller controlling the first signal and the second signal, the signal controller including an artificial intelligence based situational analyzer, receiving the vehicle data and the ambient condition data, the artificial intelligence based situational analyzer determining a stopping deceleration necessary for the first vehicle to avoid violating the first signal, and providing a violation prediction if the stopping deceleration exceeds a threshold deceleration, the threshold deceleration being modified by ambient condition data;

the violation prediction causing a modification of the control signal so as to reduce the probability of a collision between the first vehicle and the second vehicle.

2. The apparatus of claim 1, the signal controller further receiving a time signal, wherein the threshold deceleration is higher during a first time interval, the first time interval corresponding to a rush hour period.

3. The apparatus of claim 1, wherein the threshold deceleration is correlated with a typical stopping deceleration under similar ambient condition data.

4. The apparatus of claim 1, wherein the threshold deceleration is reduced if ambient condition data are correlated with a reduced road friction coefficient.

5. The apparatus of claim 1, wherein ambient condition data include temperature data.

6. The apparatus of claim 1, ambient condition data further including present precipitation data.

7. The apparatus of claim 1, wherein the threshold deceleration is reduced if the ambient condition data include an indication of present precipitation.

8. The apparatus of claim 1, wherein the apparatus further includes a memory, the memory storing ambient condition data, the threshold deceleration being reduced if stored ambient condition data include an indication of recent precipitation.

9. The signal controller of claim 1, wherein the threshold deceleration is reduced if ambient condition data include an indication of frozen water on the road surface.

10. The apparatus of claim 1, wherein the modification of the control signal provides a delayed green light to the second vehicle.

11. The apparatus of claim 10, wherein the delayed green light is a delayed green left turn arrow.

12. The apparatus of claim 1, wherein the modification of the control signal provides a green light and an additional warning light to the second vehicle.

13. The apparatus of claim 12, wherein the additional warning light is a strobe light, a red bar over the green light, a yellow light, or a white light.

14. The apparatus of claim 1, wherein the ambient condition data include temperature data and precipitation data.

15. An apparatus for controlling a traffic signal at an intersection of a first route and a second route, the traffic signal providing a first signal to a first vehicle on the first route, and a second signal to a second vehicle on the second route, the apparatus including:

a vehicle sensor, operable to provide vehicle data for the first vehicle, the vehicle data including vehicle speed and vehicle position;

a signal controller providing a control signal so as to control the first signal and the second signal, the signal controller including an artificial intelligence based situational analyzer, the artificial intelligence based situational analyzer receiving the vehicle data and determining a stopping deceleration necessary for the first vehicle to avoid violating the first signal, and providing a violation prediction if the stopping deceleration exceeds a threshold deceleration, the artificial intelligence based situational analyzer using a pattern analysis of previous vehicle data and previous signal violation events so as to determine the threshold deceleration, the violation prediction causing a modification of the control signal so as to reduce the probability of a collision between the first vehicle and the second vehicle.

16. The apparatus of claim 15, wherein apparatus further includes:

an ambient condition sensor; and a memory, wherein previous vehicle data, previous ambient condition data, and previous signal violation events are stored in the memory as stored data, the artificial intelligence based situational analyzer using a pattern analysis of stored data to determine the threshold deceleration.

17. The apparatus of claim 16, wherein the stored data further includes time data.

18. The apparatus of claim 16, wherein ambient condition data include temperature data and precipitation data.

19. The apparatus of claim 16, wherein ambient condition data include temperature data and dew point data.

20. The apparatus of claim 16, wherein ambient condition data includes data correlated with the existence of roadway water.

21. The apparatus of claim 16, wherein ambient condition data includes data correlated with the existence of fog or falling precipitation.

22. The control system of claim 16, wherein at least a part of the ambient condition data is provided by an ambient condition sensor embedded in a surface of the first route.

23. The apparatus of claim 15, the modification of the control signal operable to delay the phase of the second signal so as to reduce the probability of a collision.

24. A method of reducing a probability of a collision in an intersection having a traffic signal, the traffic signal having a signal phase, the method comprising the steps of:

providing an artificial intelligence based situational analyzer;

using the artificial intelligence based situational analyzer to determine a pattern analysis of stored data, the stored data including previous vehicle data relating to vehicles previously passing through the intersection, the stored data including previous signal violation events;

determining vehicle data for a vehicle approaching the intersection, the vehicle data including vehicle speed and vehicle position;

predicting a signal violation using comparison of the vehicle data and the signal phase to the pattern analysis of stored data; and providing a modified signal operation if signal violation is predicted, so as to reduce the probability of the collision.

25. The method of claim 24, wherein the method further includes the step of determining ambient condition data, wherein the step of predicting the signal violation includes a predicted effect of the ambient condition data.

26. The method of claim 25, wherein the ambient condition data includes an ambient temperature and a signal correlated with current precipitation.

27. The method of claim 24, wherein the method further includes the step of determining time data, wherein the step of predicting the signal violation includes a predicted effect of the time data.

* * * * *

UNITED STATES PATENT AND TRADEMARK OFFICE

CERTIFICATE OF CORRECTION

PATENT NO. : 7,317,406 B2
APPLICATION NO. : 11/050045
DATED : January 8, 2008
INVENTOR(S) : Michael J. Wolterman It is certified that error appears in the above-identified patent and that said Letters Patent is hereby corrected as shown below:

Column 13, Line 1, replace “using comparison” with --using a comparison--

Column 13, Line 4, replace “if signal” with --if the signal--

Signed and Sealed this

Twentieth Day of May, 2008

JON W. DUDAS
*Director of the United States Patent and Trademark Office*